US011383128B2

(12) United States Patent
Wilson et al.

(10) Patent No.: US 11,383,128 B2
(45) Date of Patent: Jul. 12, 2022

(54) WOBBLE BOARD

(71) Applicant: DRG Engineering, Toronto (CA)

(72) Inventors: Chris Wilson, Toronto (CA); Joel Baker, Toronto (CA); Stephen Abellera, Toronto (CA)

(73) Assignee: DRG Engineering, Toronto (CA)

( * ) Notice: Subject to any disclaimer, the term of this patent is extended or adjusted under 35 U.S.C. 154(b) by 253 days.

(21) Appl. No.: 16/382,484

(22) Filed: Apr. 12, 2019

(65) Prior Publication Data

US 2019/0314676 A1 Oct. 17, 2019

Related U.S. Application Data

(60) Provisional application No. 62/657,983, filed on Apr. 16, 2018.

(51) Int. Cl.

| | |
|---|---|
| ***A63B 22/18*** | (2006.01) |
| ***A63B 21/068*** | (2006.01) |
| ***A63B 21/00*** | (2006.01) |
| ***A63B 26/00*** | (2006.01) |
| ***A63B 21/02*** | (2006.01) |

(52) U.S. Cl.

CPC ..... *A63B 22/18* (2013.01); *A63B 21/00058* (2013.01); *A63B 21/00069* (2013.01); *A63B 21/00178* (2013.01); *A63B 21/028* (2013.01); *A63B 21/068* (2013.01); *A63B 21/4033* (2015.10); *A63B 21/4034* (2015.10); *A63B 21/4035* (2015.10); *A63B 26/003* (2013.01); *A63B 2208/0204* (2013.01); *A63B 2209/00* (2013.01); *A63B 2220/18* (2013.01);

(Continued)

(58) Field of Classification Search

CPC . A63B 21/4034; A63B 21/068; A63B 21/023; A63B 21/045; A63B 21/0421; A63B 22/18; A63B 22/16; A63B 22/00; A63B 26/00; A63B 2208/0204; A63B 2210/00; A63B 2224/09; A63B 2225/50; A63B 24/0006; A63B 2071/0072; A63B 2071/0677; A63B 2023/006; A63B 2220/40; A63B 2220/833; A63B 2220/24; A63B 2220/803; A63B 2220/10; A63B 21/4033; A63B 21/4035; A63B 21/00058; A63B 21/00069; A63B 21/00178; A63B 21/028068; A63B 22/14; A63B 26/003; Y10T 428/24008; Y10T 428/24661

USPC ..... 482/146

See application file for complete search history.

(56) References Cited

U.S. PATENT DOCUMENTS 4,193,592 A * 3/1980 Bishow ..... A63B 21/0004 482/142

4,199,137 A * 4/1980 Giguere ..... A63B 22/18 601/27

(Continued)

OTHER PUBLICATIONS

EPO; Extended European Search Report relating to EP application No. 19788335.8 dated Dec. 6, 2021.

(Continued)

*Primary Examiner* — Megan Anderson
*Assistant Examiner* — Thao N Do
(74) *Attorney, Agent, or Firm* — Rowand LLP

(57) ABSTRACT

A wobble board includes a platform, a base having a generally flat bottom surface, and at least one compressible member positioned intermediate the platform and the base such that the platform is pivotable with respect to the base.

19 Claims, 23 Drawing Sheets

(52) U.S. Cl.
CPC ..... *A63B 2220/80* (2013.01); *A63B 2225/09* (2013.01); *A63B 2230/01* (2013.01)

(56) References Cited

U.S. PATENT DOCUMENTS 4,290,601 A * 9/1981 Mittelstadt ..... A63B 22/18 482/146
4,739,986 A * 4/1988 Kucharik ..... A63B 23/08 482/79
4,905,994 A * 3/1990 Hartz ..... A63B 22/18 482/146
5,062,629 A * 11/1991 Vaughan ..... A63B 22/18 482/51
5,582,567 A * 12/1996 Chang ..... A63B 22/16 482/146
5,813,958 A * 9/1998 Tomita ..... A61H 1/0266 482/146
5,941,807 A * 8/1999 Cassidy ..... A63B 21/4009 482/130
6,306,068 B1 * 10/2001 Heatwole ..... A63B 26/003 482/146
6,428,451 B1 * 8/2002 Hall ..... A63G 23/00 482/79
6,695,755 B1 * 2/2004 Huang ..... A63B 22/18 482/79
6,723,030 B1 * 4/2004 Chen ..... A63B 22/18 482/79
7,137,938 B2 * 11/2006 Gottlieb ..... A63B 22/18 482/79
7,591,774 B1 * 9/2009 Tien ..... A63B 22/14 482/146
9,457,226 B2 * 10/2016 Heath ..... A63B 21/0004
9,750,980 B1 * 9/2017 Khalili ..... A63B 21/0004
9,987,518 B1 * 6/2018 Stack ..... A63B 21/4049
10,434,371 B2 * 10/2019 Shoffler ..... A63B 22/18
2002/0077231 A1 * 6/2002 Dalebout ..... A63B 22/18 482/146
2002/0151417 A1 * 10/2002 List ..... A63B 21/169 482/146
2003/0032533 A1 * 2/2003 Hecox ..... A63B 22/18 482/130
2003/0181300 A1 * 9/2003 Chin ..... A63B 22/14 482/146
2004/0009859 A1 * 1/2004 Gottlieb ..... A63B 21/0004 482/146
2004/0023766 A1 * 2/2004 Slone ..... A63B 26/003 482/146
2004/0142802 A1 * 7/2004 Greenspan ..... A61H 1/0237 482/146
2007/0054791 A1 * 3/2007 Langer ..... A63B 21/0004 482/146
2007/0117697 A1 * 5/2007 Genua ..... A63B 22/18 482/146
2007/0298947 A1 * 12/2007 Eksteen ..... A63B 22/20 482/141
2009/0227426 A1 * 9/2009 Dubar ..... A63B 69/0093 482/146
2009/0275451 A1 * 11/2009 Chiang ..... A63B 22/18 482/146
2010/0087301 A1 * 4/2010 Juncker ..... A63B 21/0004 482/146
2011/0263398 A1 * 10/2011 Klassen ..... A63B 22/18 482/146
2012/0214650 A1 * 8/2012 Jahns ..... A63B 21/0455 482/121
2012/0264579 A1 * 10/2012 Klein ..... A63B 22/18 482/146
2013/0116100 A1 * 5/2013 Chen ..... A63B 26/003 482/146
2013/0288866 A1 * 10/2013 Rainey ..... A63B 22/18 482/146
2014/0162852 A1 * 6/2014 Ho ..... A63B 21/4033 482/92
2015/0018178 A1 * 1/2015 Carbone ..... A63B 71/0009 482/146
2015/0174450 A1 * 6/2015 Jhang ..... A63B 69/0093 482/146
2015/0190679 A1 * 7/2015 Carbone ..... A63B 21/00069 482/146
2015/0238816 A1 * 8/2015 Naderer ..... A63B 22/0023 482/4
2015/0251056 A1 * 9/2015 Crist ..... A63B 22/16 482/146
2016/0089576 A1 * 3/2016 Rosenstiel ..... A63B 21/4047 482/146
2016/0206918 A1 * 7/2016 Palmer ..... A63B 69/18
2016/0256746 A1 * 9/2016 Kramer ..... A63B 21/4033
2017/0172331 A1 * 6/2017 Publicover ..... B32B 7/022
2017/0231549 A1 * 8/2017 Kogler ..... A63B 22/18 600/595
2018/0015322 A1 * 1/2018 Carr ..... A63B 22/203
2018/0117384 A1 * 5/2018 Endelman ..... A63B 21/025
2018/0133553 A1 * 5/2018 Kramer ..... A63C 17/01
2018/0185702 A1 * 7/2018 Brown ..... A63B 23/0355
2018/0193693 A1 * 7/2018 Youm ..... G01P 13/00
2019/0054348 A1 * 2/2019 Polinsky ..... A63B 26/003
2019/0184227 A1 * 6/2019 Gouzenko ..... A63G 23/00

OTHER PUBLICATIONS

EPO; Communication pursuant to Rules 70(2) and 70a(2) EPC relating to EP application No. 19788335.8 dated Dec. 23, 2021.

* cited by examiner

WOBBLE BOARD

CROSS-REFERENCE TO RELATED APPLICATIONS

This application claims priority to and the benefit of U.S. Provisional Patent Application No. 62/657,982 filed on Apr. 16, 2018. The disclosures of the above applications are incorporated herein by reference.

FIELD

The present disclosure relates to balance boards and in particular to wobble boards.

BACKGROUND

The statements in this section merely provide background information related to the present disclosure and may not constitute prior art.

Balance boards are used for recreation, balance training, athletic training, physiotherapy, rehabilitation and other kinds of personal development. Balance boards can also be used by a user working at a stand-up desk. One type of balance board is a wobble board.

Wobble boards pivot in all directions: forward-backward, left-right, and anywhere in between, i.e. 360 degrees. Standing on a wobble board exercises muscles that are not exercised by standing on a balance board that tilts in only two (opposite) directions.

The basic exercise of using a wobble board is standing on the wobble board with both feet and tilting it in any direction without letting the board tilt so far that its edges touch the ground.

Various wobble boards have been considered. U.S. Pat. No. 9,457,226 to Heath discloses a work platform that has a top member with a surface sized to receive a user's feet thereon while standing and a bottom member coupled to the top member. The bottom member has a width and length generally equal to the width and length of the top member. The bottom member has a curved surface generally at the longitudinal center of the work platform defined at least partially by a radius of curvature of between about 100 mm and about 850 mm. The curved surface induces instability under a user standing on the top member to thereby facilitate active muscle engagement in the user's legs while standing on the work platform.

U.S. Patent Application Publication No. 2010/0087301 to Juncker discloses a balancing device comprising a board member and a pivoting member comprising a contact face for abutting a surface, wherein said pivoting member comprises integrated contact face adjusting means for changing the geometrical shape of said contact face.

Although wobble boards have been considered, improvements are desired. It is therefore an object at least to provide a novel wobble board.

SUMMARY

It should be appreciated that this Summary is provided to introduce a selection of concepts in a simplified form that are further described below in the Detailed Description. This Summary is not intended to be used to limit the scope of the claimed subject matter.

Accordingly, in one aspect there is provided a wobble board comprising a platform, a base having a generally flat bottom surface, and at least one compressible member positioned intermediate the platform and the base such that the platform is pivotable with respect to the base.

In one or more forms, the at least one compressible member compresses in response to an axial force being applied thereto.

In one or more forms, the wobble board comprises an adjustment mechanism configured to adjust a level of compression of the at least one compressible member.

In one or more forms, the axial force is at least partially from the adjustment mechanism.

In one or more forms, the adjustment mechanism comprises a threaded member connecting the platform to the base.

In one or more forms, rotation of the platform relative to the base via the threaded member adjusts the level of compression of the at least one compressible member.

In one or more forms, the wobble board is adjustable and useable in a single mode.

In one or more forms, the wobble board comprises a locking mechanism configured to set the wobble board in use mode or adjustment mode.

In one or more forms, in a first position, the locking mechanism sets the wobble board to use mode, and in a second position, the locking mechanism sets the wobble board to adjustment mode.

In one or more forms, the locking mechanism is rotatable between the first and second positions.

In one or more forms, the locking mechanism is positioned on a top surface of the platform.

In one or more forms, the locking member comprises an interlocking plate positioned on the top surface of the platform and comprising at least one inclined groove, and a disc comprising a plurality of teeth positioned within an opening of the platform adjacent the interlocking plate, the disc having at least one locking member projecting from a surface thereof.

In one or more forms, in the first position, the locking member is positioned within the inclined groove at a lowest point thereof, and in the second position the locking member is positioned within the inclined groove at a highest position thereof.

In one or more forms, the greater the level of compression of the at least one compressible member the less range of pivot the platform has relative to the base.

In one or more forms, the axial force is at least partially from a force being applied to a top surface of the platform.

In one or more forms, the force applied to the top surface of the platform is from a user standing on the platform.

In one or more forms, the base is positioned on a support surface, the support defining a pivot limit of the platform.

In one or more forms, at least a portion of the platform is in contact with the support surface when at the pivot limit.

In one or more forms, the at least one compressible member is made of one of an elastic material, a rubber material and a foam material.

In one or more forms, the at least one compressible member has a rounded top surface.

In one or more forms, the at least one compressible member compresses axially.

In one or more forms, the at least one compressible member expands radially when compressed axially.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
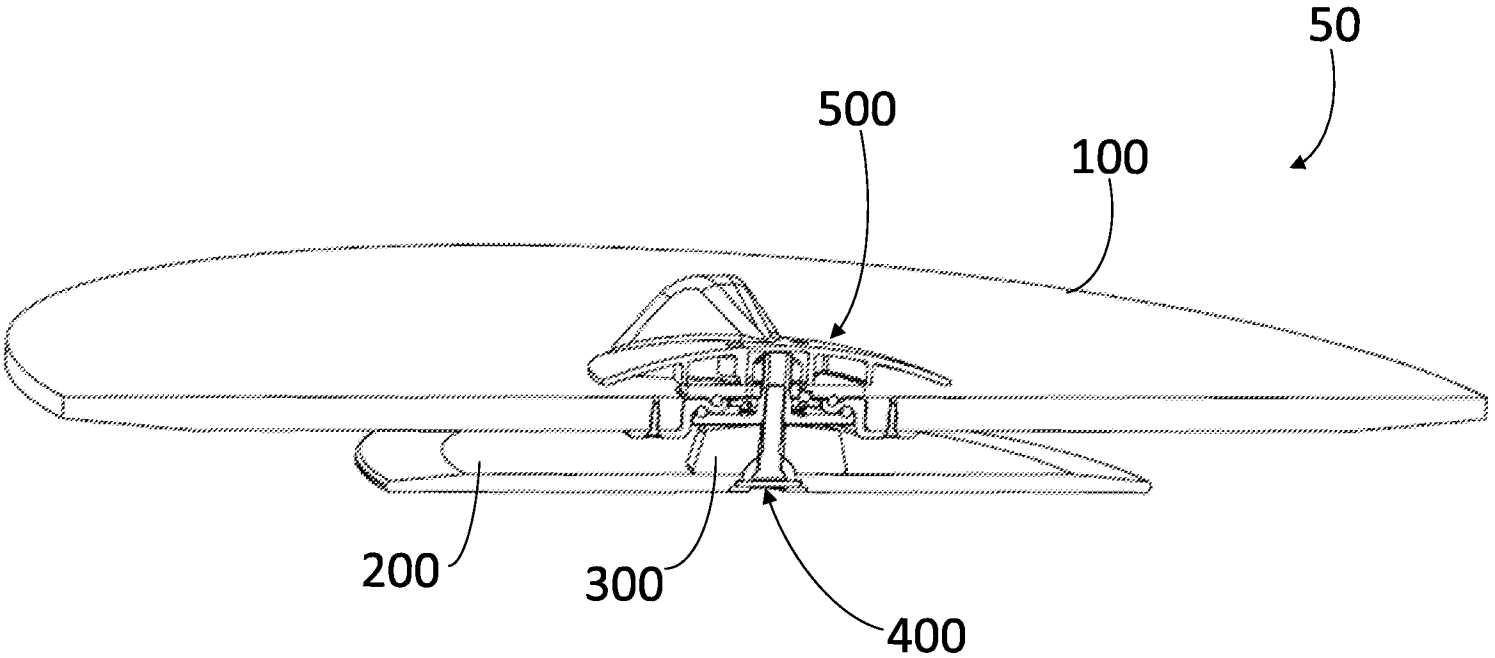
FIG. 1 is a cross-sectional view of a wobble board.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example," "one form," or "one embodiment" are not intended to be interpreted as excluding the existence of additional examples, forms, or embodiments that also incorporate the described elements or features. Moreover, unless explicitly stated to the contrary, examples, forms, or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

It will be understood that a wobble board may also be referred to in the art as a work platform, balancing device, platform for work while standing, balance board, etc.

Figure 2:
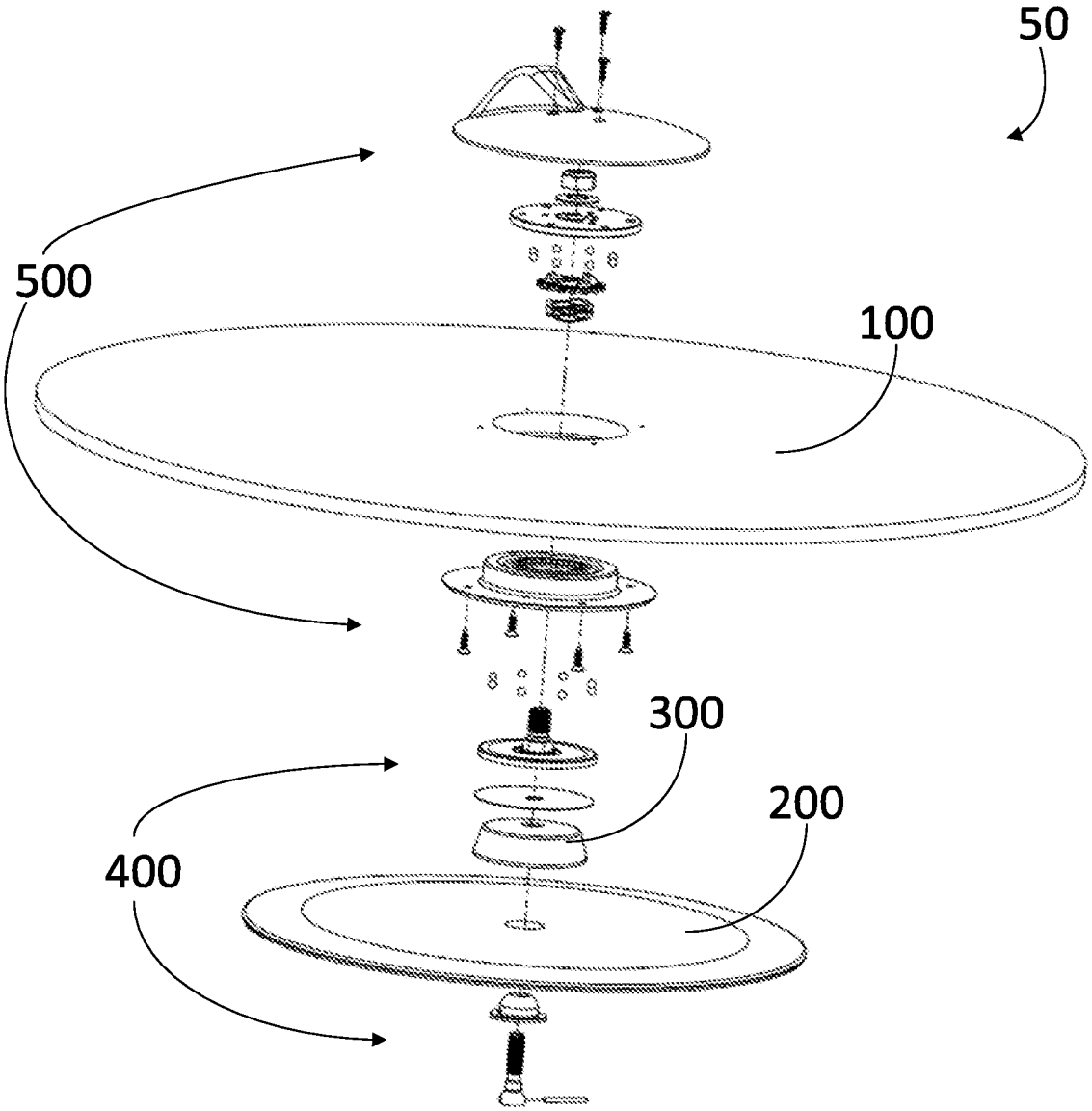
FIG. 2 is an exploded view of the wobble board of FIG. 1.

Turning to FIGS. 1 and 2, a wobble board is shown and is generally identified by reference numeral 50. In this form, the wobble board comprises a platform 100, a base 200, a compressible member 300, an adjustment mechanism 400 and a locking mechanism 500. The compressible member 300 is positioned intermediate the platform 100 and the base 200. The compressible member 300 allows the platform 100 to pivot with respect to the base 200 in all directions, that is, forward, backward, left, right, and anywhere in between, i.e. 360 degrees. As will be appreciated, the limit as to how much the platform 100 can pivot with respect to the base 200 is defined by a support surface on which the wobble board 50 is placed, which is typically a floor. The adjustment mechanism 400 extends from the base 200 to the platform 100 and is used to adjust a level of compression of the compressible member 300. The locking mechanism 500 is positioned above the compressible member 300 and is used to set the wobble board 50 in use mode or adjustment mode. Put another way, the locking mechanism 500 enables the adjustment mechanism 400 to adjust the level of compression of the compressible member 300, as will be described in more detail below.

Figure 3:
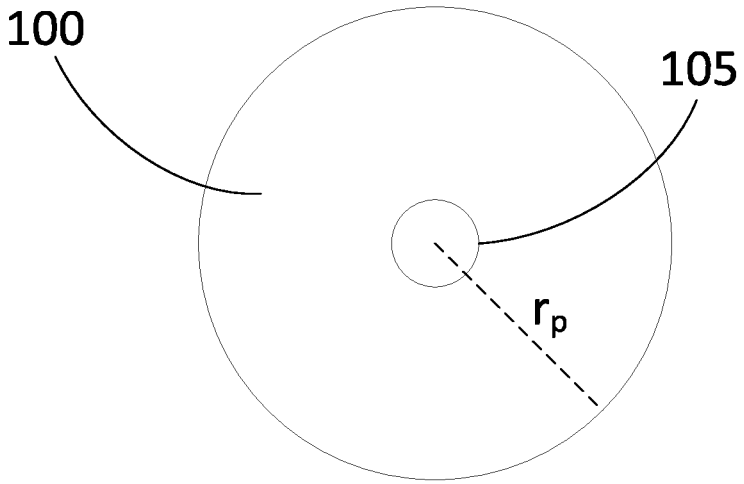
FIG. 3 is a top view of a platform forming part of the wobble board of FIG. 1.

As shown in FIG. 3, in this form the platform 100 is generally annular shaped and has a circular opening 105 defined therein. The platform 100 has a radius $r_p$ defined from a center thereof. The opening 105 is located at the center of the platform 100. In this form, the platform 100 is made of wood. As will be appreciated, in other forms the platform 100 may be made of any rigid material such as for example metal, plastic or laminate.

Figure 4:
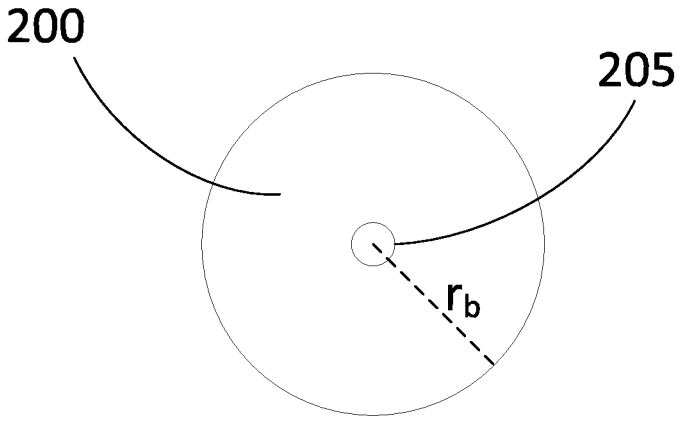
FIG. 4 is a top view of a base forming part of the wobble board of FIG. 1.

As shown in FIG. 4, in this form, the base 200 is generally annular shaped and has a circular opening 205 defined therein. The base 200 has a radius $r_b$ defined from a center thereof. The radius $r_b$ of the base 200 is less than the radius $r_p$ of the platform 100. The opening 205 is located at the center of the base 200. In this form, the base 200 is made of metal. As will be appreciated, in other forms the base 200 may be made of any rigid material such as for example wood, plastic or laminate.

Figure 5A:
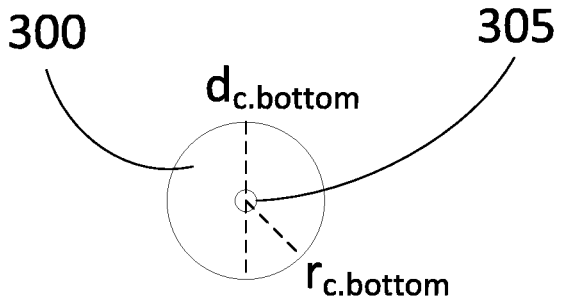
FIGS. 5A and 5B are a bottom view and a cross-sectional view, respectively, of a compressible member forming part of the wobble board of FIG. 1.
Figure 5B:
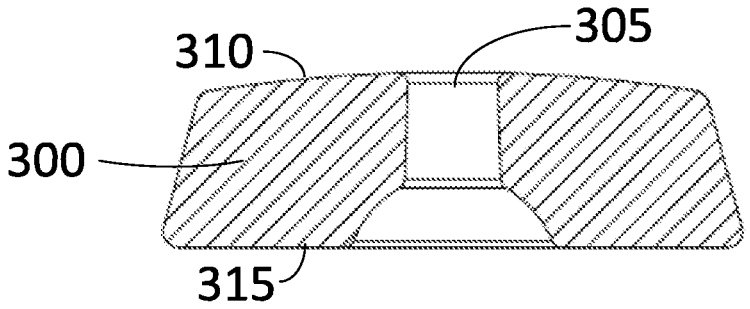

As shown in FIGS. 5A and 5B, in this form the compressible member 300 is generally frustoconical shaped and has an opening 305 defined therein. The compressible member 300 has a rounded top surface 310. The opening 305 extends from the top surface 310 to a bottom surface 315. The bottom surface 315 has a radius $r_{c.bottom}$ defined from a center thereof. The top surface 310 has a radius (not shown) less than the radius $r_{c.bottom}$. The bottom surface 315 has a diameter $d_{c.bottom}$ that is greater than a diameter of the circular opening 205 of the base 200. The diameter $d_{c.bottom}$ is less than a diameter of the platform 100 and the base 200. In this form, the compressible member 300 is made of an elastic material such as for example rubber or elastomer. As such, the compressible member 300 expands radially in response to an axial force applied thereto. The compressible member 300 is positioned such that the bottom surface 315 is in contact with a top surface of the base 200 and the opening 305 of the compressible member 300 is aligned with the opening 205 of the base 200. The compressible member 300 is secured intermediate the platform 100 and the base 200 using components of the adjustment mechanism 400 and the locking mechanism 500, as will be described.

The adjustment mechanism 400 is shown in FIGS. 6 to 9. In this form, the adjustment mechanism 400 comprises a stem 405, a socket 410, a dowel pin 415, a washer 420 and a chassis 425.

Figure 7:
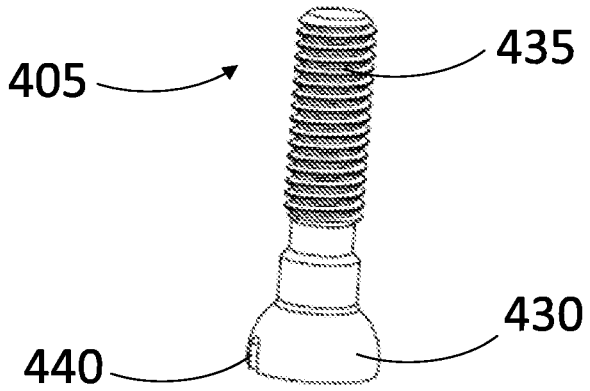
FIG. 7 is an isometric view of a stem forming part of the adjustment mechanism of FIG. 6.

As best shown in FIG. 7, the stem 405 comprises a head 430 and a threaded shank 435 extending therefrom. An opening 440 extends through the head 430. The opening 440 is dimensioned to receive the dowel pin 415.

Figure 8:
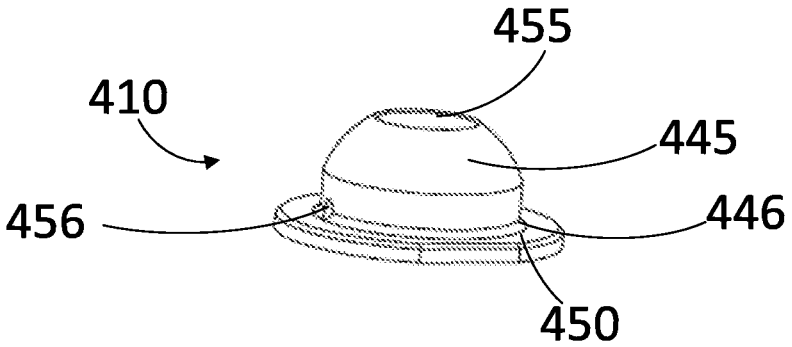
FIG. 8 is an isometric view of a socket forming part of the adjustment mechanism of FIG. 6.

As shown in FIG. 8, the socket 410 comprises body 445 dimensioned to fit within the opening 205 of the base 200. The body 445 is generally inverted bowl-shaped, that is, the body 445 is generally concave-shaped and has an open bottom 446. A flange 450 extends about a periphery of the open bottom 446 of the body 415. When the body 445 is positioned in the opening 205 of the base, the flange 450 provides that the body 445 does not pass entirely therethrough. An opening 455 is defined on the concave-shaped portion of the body 445, opposite the open bottom 446. Openings 456 are defined on opposite sides of the body 445 adjacent the flange 450. The openings 456 are dimensioned to receive the dowel pin 415.

Figure 6:
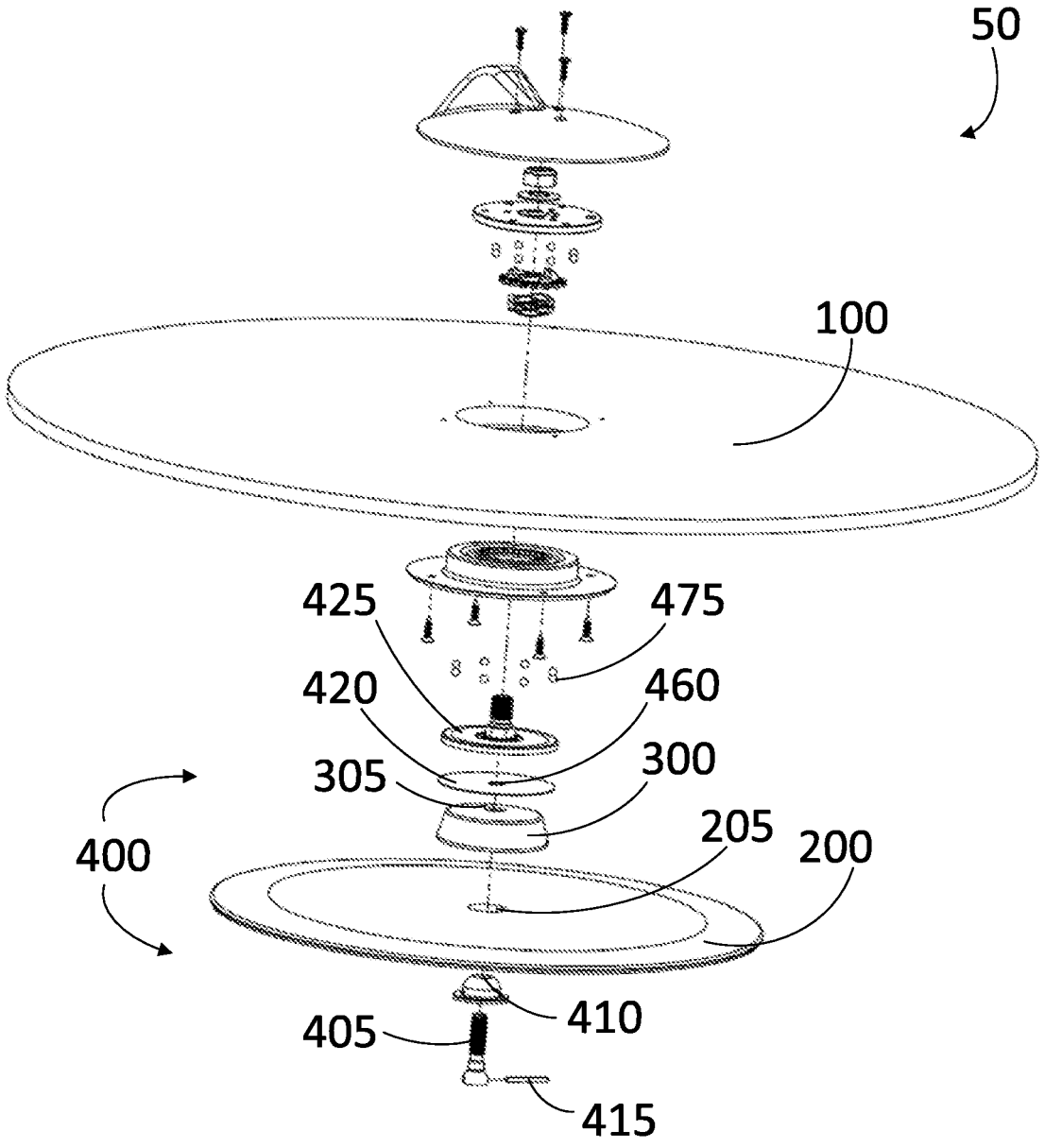
FIG. 6 is an exploded view identifying elements of an adjustment mechanism forming part of the wobble board of FIG. 1.

As best shown in FIG. 6, the washer 420 is generally annular shaped and has a circular opening 460 defined therein. As will be appreciated, in other forms multiple washers may be used.

Figure 9:
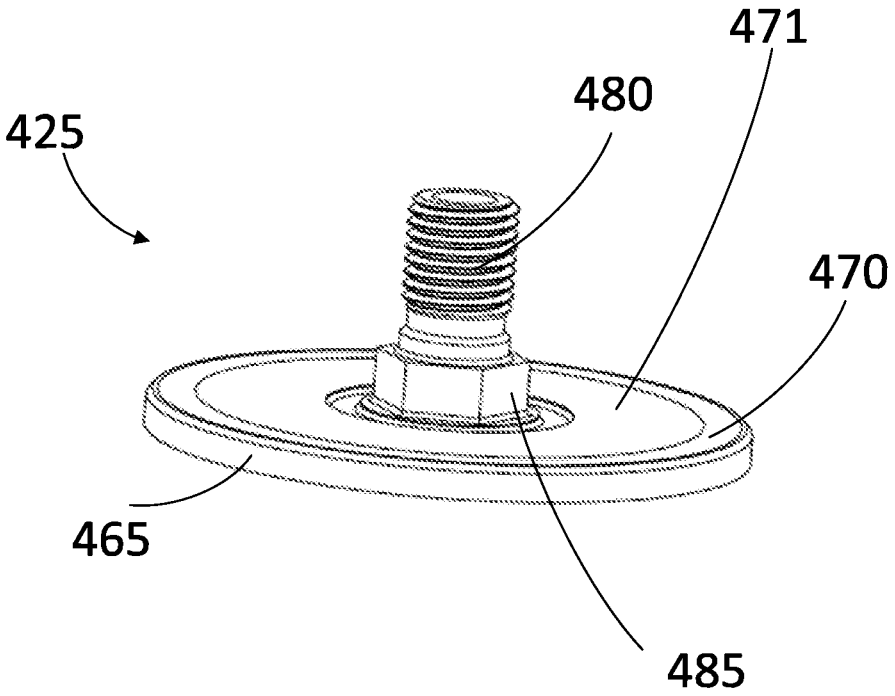
FIG. 9 is an isometric view of a chassis forming part of the adjustment mechanism of FIG. 6.
Figure 10:
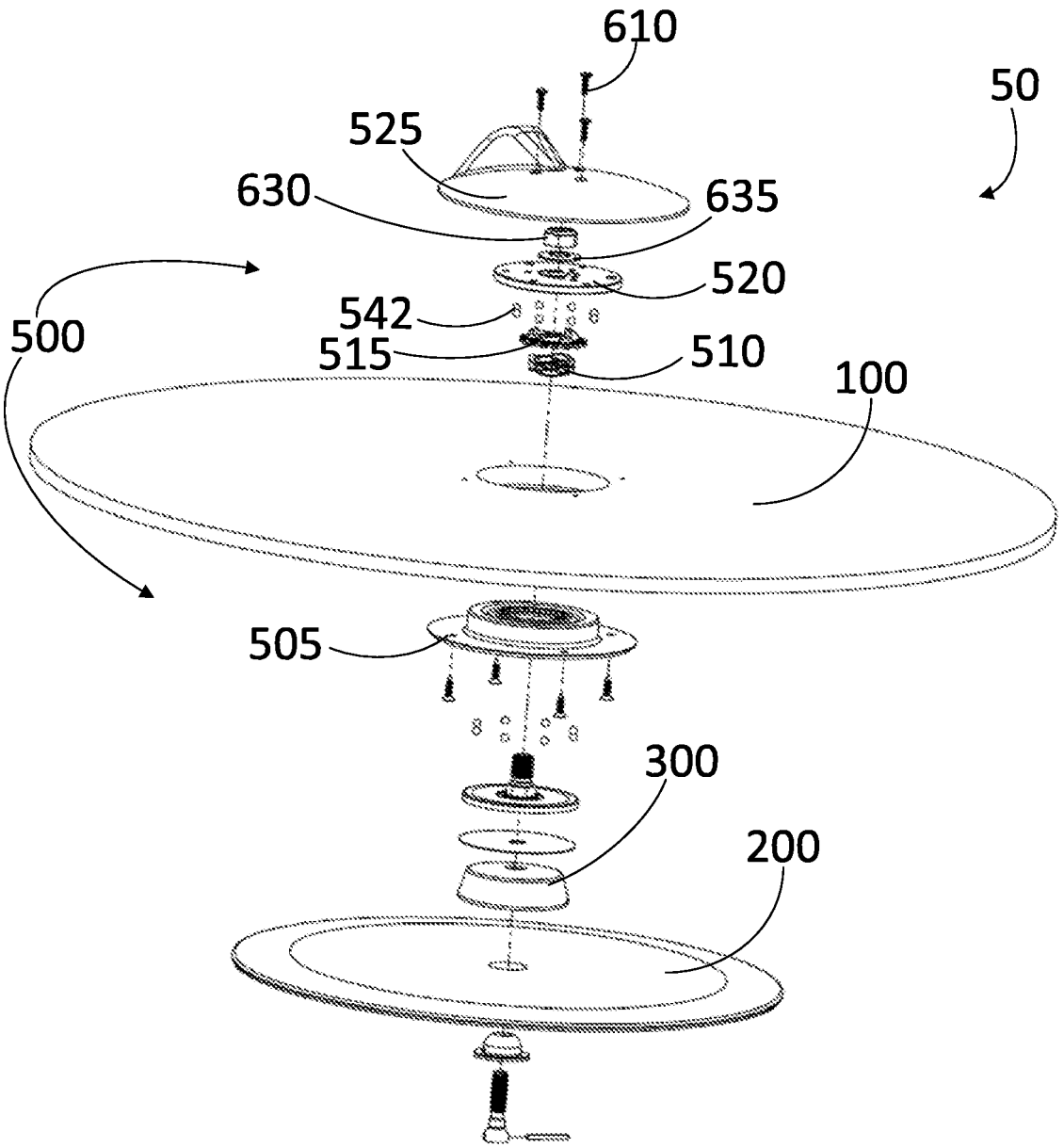
FIG. 10 is an exploded view identifying elements of a locking mechanism forming part of the wobble board of FIG. 1.

As shown in FIG. 9, the chassis 425 comprises a generally annular shaped body 465. A groove 470 is defined about the circumference of a top surface 471 of the body 465. The groove 470 is dimensioned to receive and retain ball bearings 475 (shown in FIG. 6) therein. A threaded member 480 extends from the top surface 471 of the body 465 and is dimensioned to receive and mate with the threaded shank 435 of the stem 405. A nut 485 is positioned around a base of the threaded member 480 and is in contact with the top surface 471 of the body 465. The nut 485 is secured to the threaded member 480.

During assembly of the wobble board 50, the head 430 of the stem 405 is positioned within the body 445 of the socket 410. The dowel pin 415 is inserted through a first one of the openings 456 on the body 445, through the opening 440 of the head 430, and through a second one of the openings 456 on the body 445. As such, the stem 405 is fixed in position axially within the socket 410. The threaded shank 435 of the stem 405 extends through the opening 455 on the body 445 of the socket 410. The washer 420 is positioned above the compressible member 300 such that the opening 460 of the washer 420 is aligned with the opening 305 of the compressible member 300. The chassis 425 is positioned above the washer 420 and the compressible member 300 such that the threaded member 480 is aligned with the opening 460 of the washer 420 and the opening 305 of the compressible member 300. The socket 410, together with the stem 405, is positioned in the opening 205 of the base 200. In this manner, the threaded shank 435 extends through the opening 305 of the compressible member 300 and the opening 460 of the washer 420 and into the threaded member 480 of the chassis 425. The ball bearings 475 are positioned within the groove 470 of the chassis 425. The threaded member 480 of the chassis 425 is connected to components of the locking mechanism 500, as will be described.

The locking mechanism 500 in FIGS. 10 to 14. In this form, the locking mechanism 500 comprises a bearing plate 505, an interlock spring 510, an interlock disc 515, an interlock trigger plate 520 and a locking member 525.

Figure 11:
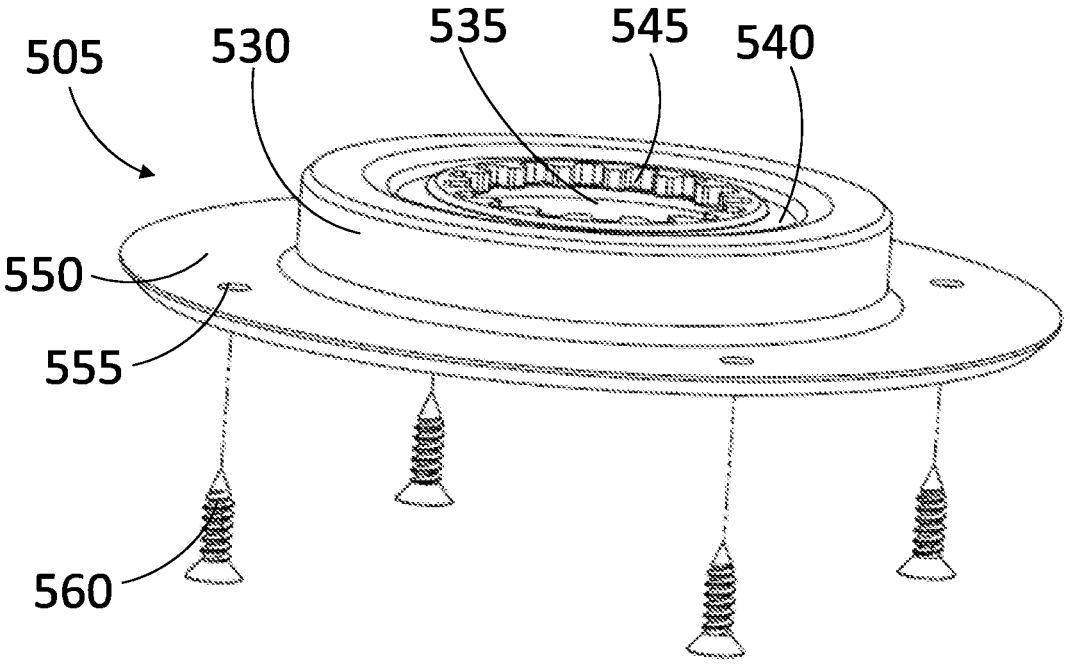
FIG. 11 is an isometric view of a bearing plate forming part of the locking mechanism of FIG. 10.

As shown in FIG. 11, the bearing plate 505 comprises a generally annular body 530 having an opening 535. The body 530 is dimensioned to extend through the opening 105 of the platform 100. A groove 540 extends about a periphery of one end of the body 530, radially outward from the opening 535, and is configured to receive and retain ball bearings 542 (shown in FIG. 10) therein. Teeth 545 extend radially inward from the opening 535 of the body 530. A flange 550 extends adjacent an opposite end of the body 530. Openings 555 are defined in the flange 550, each of which is dimensioned to receive a fastening member 560 which in this form is a screw. The fastening members 560 connect the bearing plate 505 to a bottom surface of the platform 100.

The interlock spring 510 (shown in FIG. 10) is used to exert a generally upward force on the interlock disc 515. The generally upward force encourages contact between the interlock disc 515 and the interlock plate 520 and helps to provide that teeth of the interlock disc 515 remain engaged during adjustment mode, as will be described in more detail below.

Figure 12:
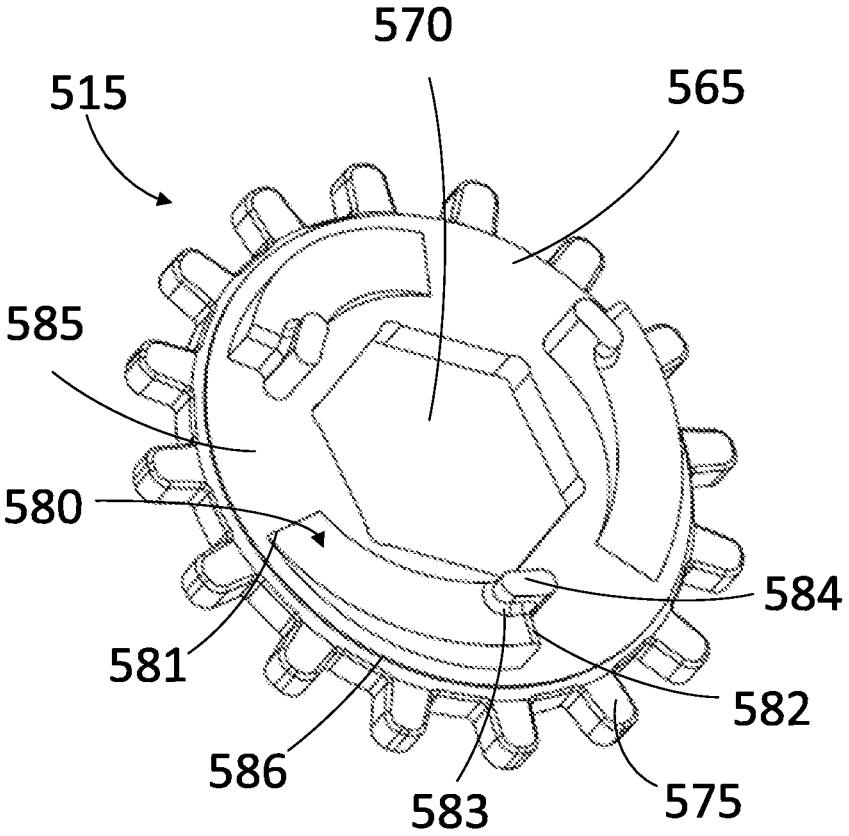
FIG. 12 is an isometric view of an interlock disc forming part of the locking mechanism of FIG. 10.

As shown in FIG. 12, the interlock disc 515 comprises a generally annular body 565 having a hexagonal shaped opening 570 defined therein. The hexagonal shaped opening 570 is dimensioned to receive and engage with the nut 485 of the of the chassis 425. Teeth 575 extend radially outward from the body 565 and are dimensioned to mate with the teeth 545 of the bearing plate 505. A number of projections 580, which in this form is three (3) projections 580, are positioned on a top surface 585 of the body 565 at spaced apart locations from one another.

In this form, each projection 580 is positioned on the top surface 585 of the body 565 inset from an outer edge 586 thereof. Each projection 580 is in the shape of a curved-ramp and comprises a first upper surface 581 and a second upper surface 582. The first upper surface 581 is generally flush with the top surface 585 of the body 565. The second upper surface 582 extends a distance above the top surface 585. The curve of the curved-ramp is generally equal to that of the outer edge 586 of the body 565. An opening 583 is defined on the projection 580 adjacent the second upper surface 582. A tab 584 extends up from the second upper surface 582 over top of the opening 532.

Figure 13:
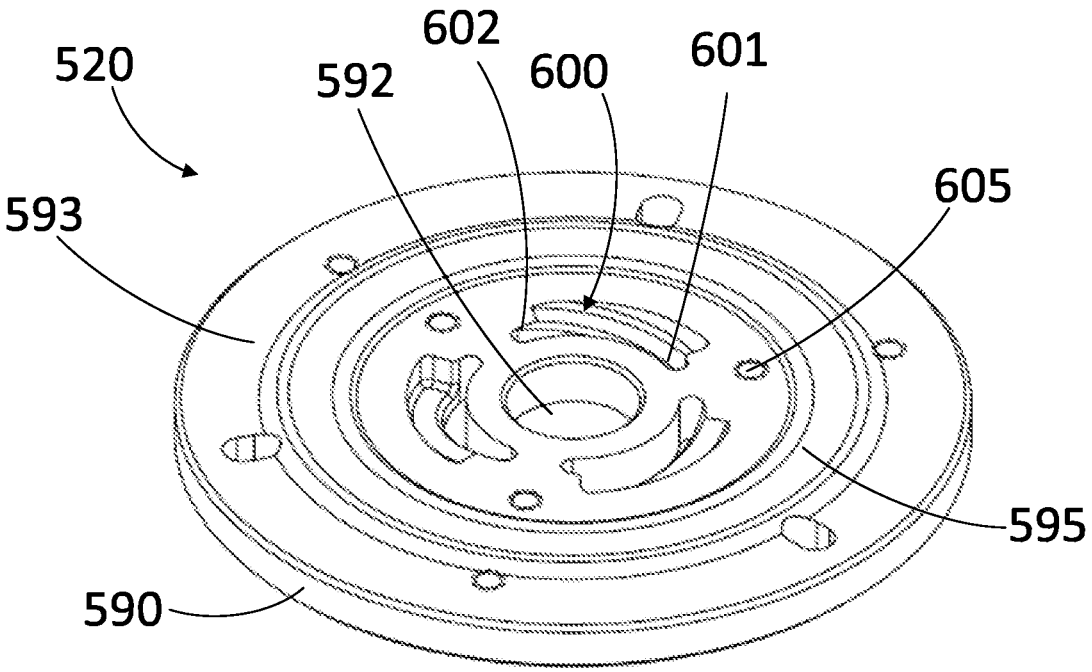
FIG. 13 is a bottom view of an interlock trigger plate forming part of the locking mechanism of FIG. 10.

A bottom view of the interlock trigger plate 520 is shown in FIG. 13. As can be seen, the interlock trigger plate 520 comprises a generally annular body 590 having an opening 592. A groove 595 extends about a periphery of a bottom surface 593 of the body 590. The groove 595 is dimensioned to receive and retain ball bearings 542 (shown in FIG. 10). A number of inclined grooves 600, which in this form is three (3) inclined grooves 600, are defined on the bottom surface 593 of the body 590 at spaced apart locations from one another. The location and number of inclined grooves 600 corresponds to that of the location and number of projections 580 that extend from the body 565 of the interlock disc 515. Further, each inclined groove 600 is dimensioned and shaped to correspond to or complement one of the projections 580 of the interlock disc 515.

In this form, each inclined groove 600 has a first end 601 that is generally flush with the bottom surface 593 of the body 590 and a second end 602 that is set in the body 590. A depth of each groove 600 gradually increases from the first end 601 to the second end 602. Openings 605 are defined on the body 590, each of which is dimensioned to receive one of fastening members 610 (shown in FIG. 10) which in this form is a screw.

Figure 14:
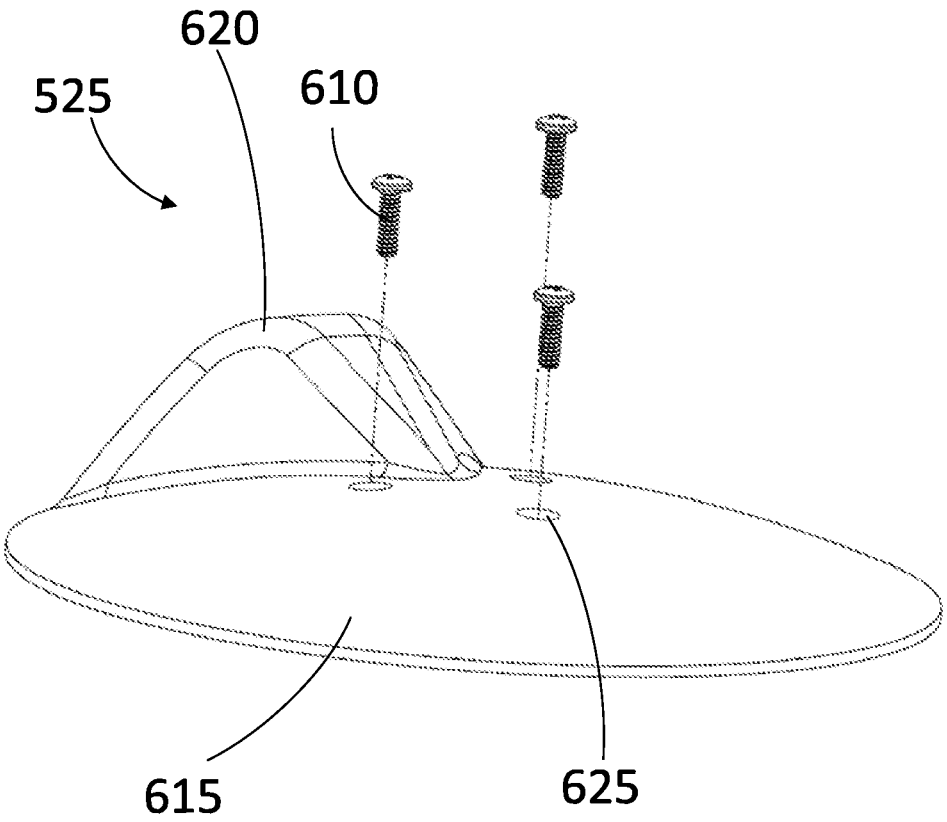
FIG. 14 is an isometric view of a locking member forming part of the locking mechanism of FIG. 10.

As shown in FIG. 14, the locking member 525 comprises a dome-shaped body 615. A locking tab 620 extends from a top surface of the locking member 525. Openings 625 extend through the body 615, each of which is dimensioned to receive one of the fastening members 610 (shown in FIG. 10). The fastening members 610 are used to connect the locking member 525 to the interlock trigger plate 520. A locknut 630 and retaining disc 635 (shown in FIG. 10) are also used to connect the locking member 525 to the interlock trigger plate 520.

During assembly of the wobble board 50, the bearing plate 505 is inserted into the opening 105 of the platform 100. The fastening members 560 are inserted through openings 555 and are screwed into the bottom surface of the platform 100. The platform 100 along with the bearing plate 505 are positioned on top of the chassis 425 such that the threaded member 480 of the chassis 425 extends through the opening 535 of the bearing plate. A bottom surface of the bearing plate 505 is in contact with the ball bearings 475. The interlock spring 510 is positioned such that it is in contact with top surface 471 of the chassis 425 and such that it encircles the nut 485 and threaded member 480 of the chassis 425. The interlock disc 515 is inserted into the opening 535 of the bearing plate 505. The hexagonal shaped opening 570 engages with the nut 485 of the chassis 425. The projections 580 of the interlock disc 515 extend generally upward. As the interlock disc 515 compresses the interlock spring 510, the interlock spring 510 exerts a generally upward force on the interlock disc 515. Ball bearings 542 are positioned within the groove 540 of the bearing plate 505.

In this form, the wobble board 50 is operable in two modes: use mode and adjustment mode. As will be described, during use mode a user stands on the top surface of the platform and tries to maintain the wobble board 50 in a balanced position. During adjustment mode, a level of compression of the compressible member is adjusted to increase or decrease the difficulty of use of the wobble board 50 based on the user's preference.

Figure 15:
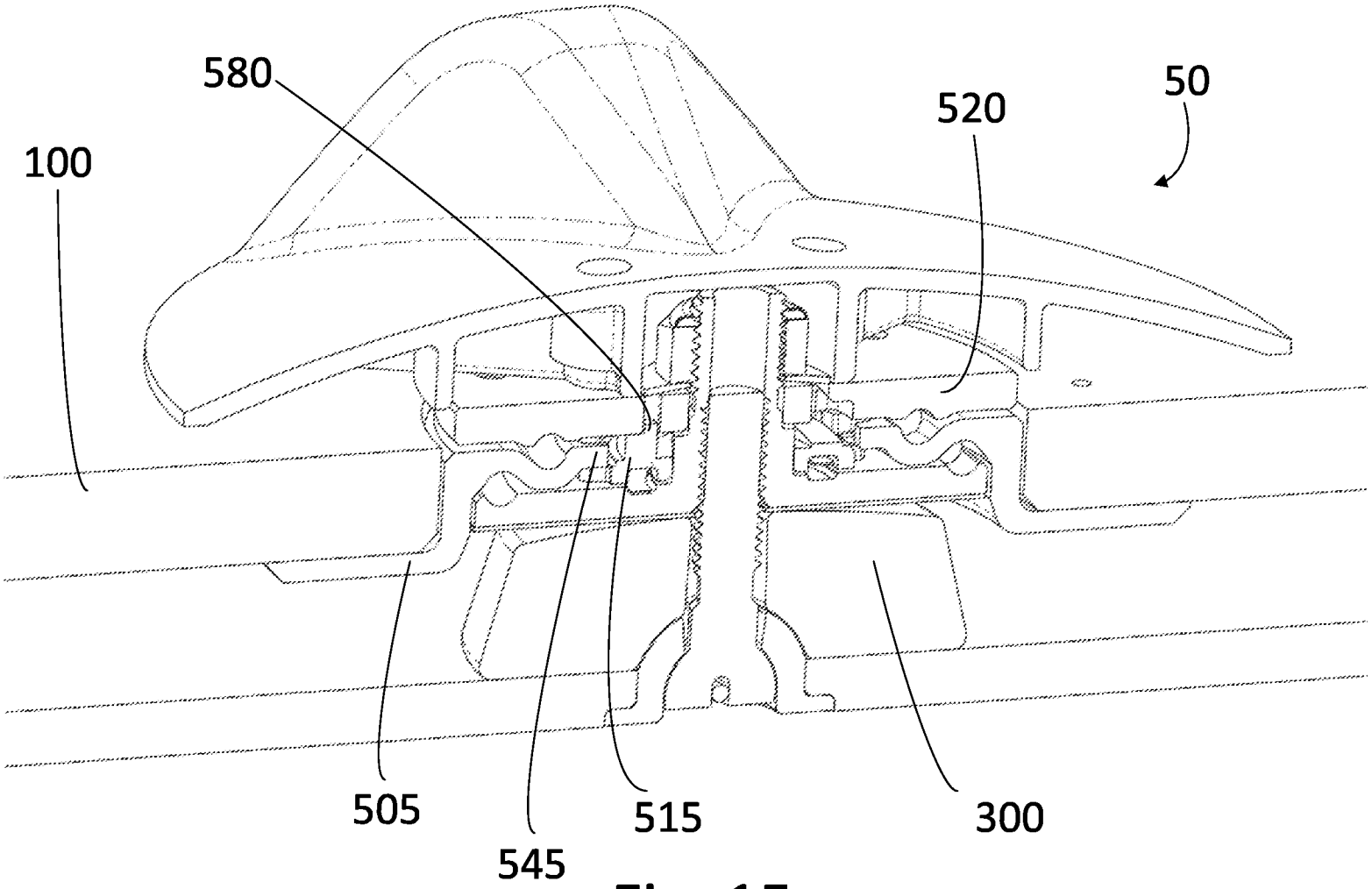
FIG. 15 is a cross-sectional view of the wobble board of FIG. 1 in use mode.

A cross-sectional view of the wobble board 50 in use mode is shown in FIG. 15. As can be seen, the interlock disc 515 is positioned such that the tab 584 of each projection 580 is positioned in the first end 601 of a corresponding inclined groove 600. In this position, the teeth 575 of the interlock disc 515 are not engaged with the teeth 545 of the bearing plate 505. In the example shown, the level of compression of the compressible member 300 is at a minimum and as such the wobble board 50 is at a least stable setting.

Figure 16:
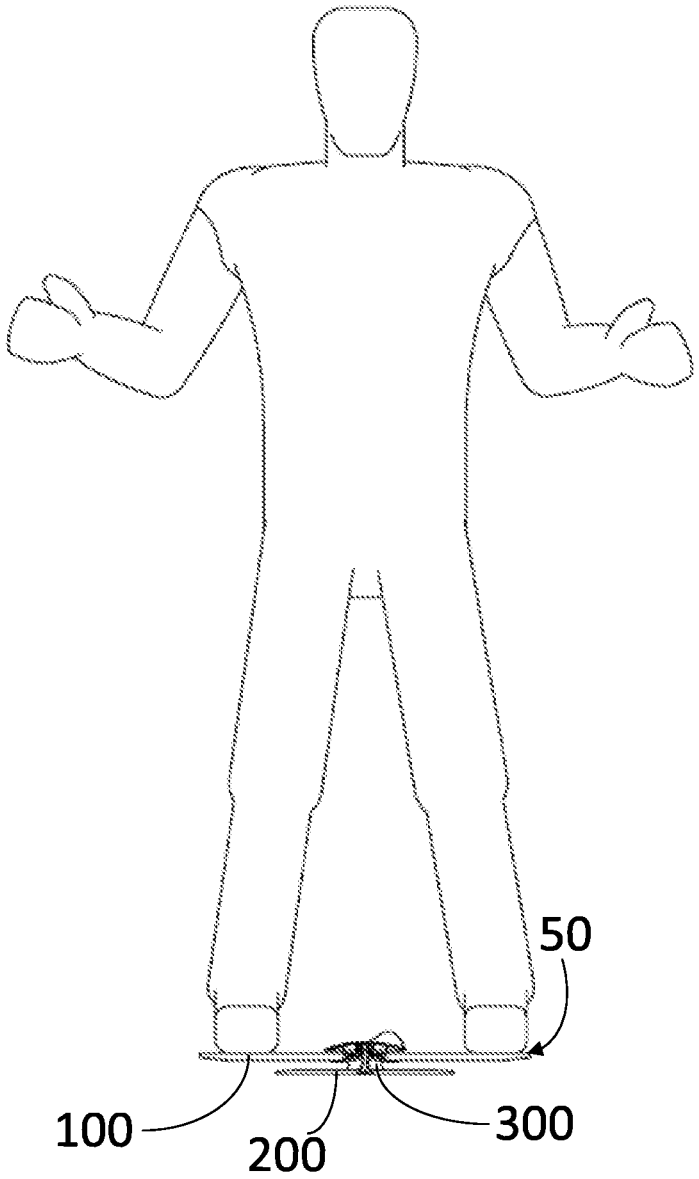
FIG. 16 is a plan view of the wobble board of FIG. 1 with a user standing on the platform thereof, the wobble board being balanced.
Figure 17:
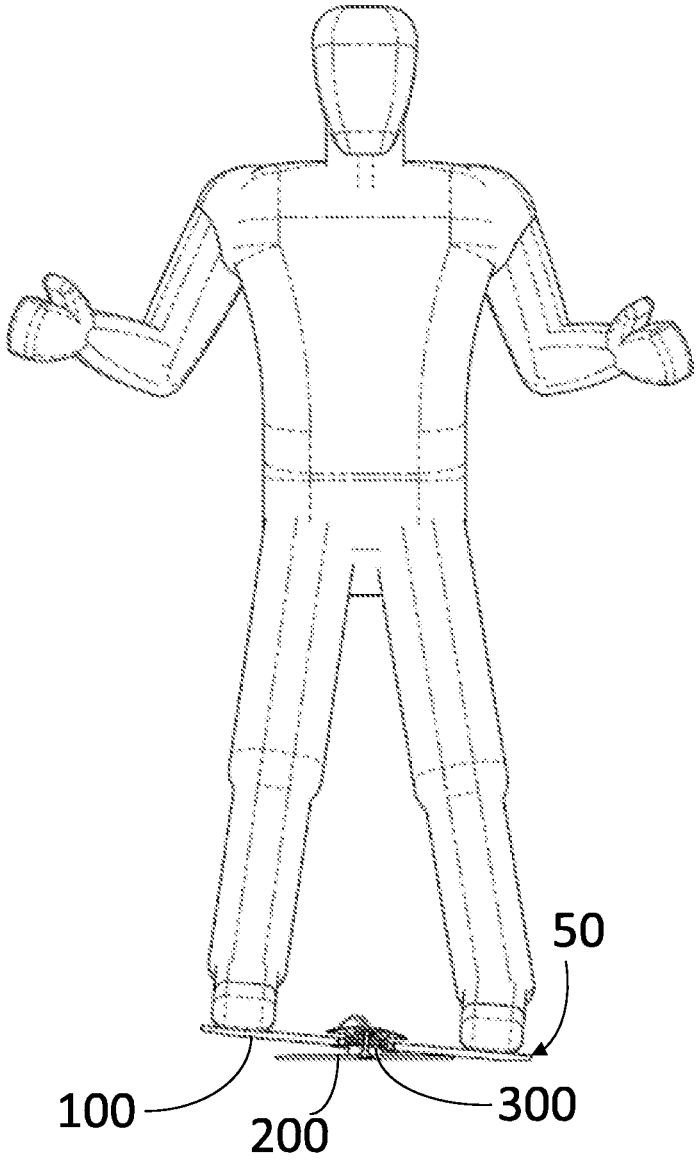
FIG. 17 is another plan view of the wobble board of FIG. 1 with a user standing on the platform thereof, the wobble board being unbalanced.

During operation in the use mode, a user stands on the top surface of the platform 100 as shown in FIG. 16. The weight of the user causes an axial force to be applied to the compressible member 300 and in response the compressible member 300 compresses. As the user's weight shifts on top of the wobble board 50, the platform 100 pivots with respect to the base 200. As mentioned previously, the platform 100 is able to pivot with respect to the base 200 in all directions, forward, backward, left, right, and anywhere in between, i.e. 360 degrees. In this form, the limit as to how much the platform 100 can pivot with respect to the base 200 is defined by a support surface on which the wobble board 50 is placed on. Put another way, the platform 100 can only pivot with respect to the base 200 until a portion of the platform 100 contacts the support surface, thereby inhibiting further pivot. An example of this is shown in FIG. 17. As will be appreciated, since the compressible member 300 is made of an elastic material, the threaded member 480 is able to pivot by slightly deforming the compressible member 300 in the direction of pivot. In use mode, the platform 100 is also able to spin/rotate with respect to the base 200.

To transition operation the wobble board 50 from use mode to adjustment mode, the locking tab 620 of the locking member 525 is rotated in a direction, which in this form is clock-wise. As the locking tab 620 is rotated, each projection 580 travels up the respective inclined groove 600 until the tab 584 is positioned in the second end 602 of the corresponding inclined groove 600. The interlock spring 510 further helps each projection 580 travel up the respective inclined groove 600.

Figure 18:
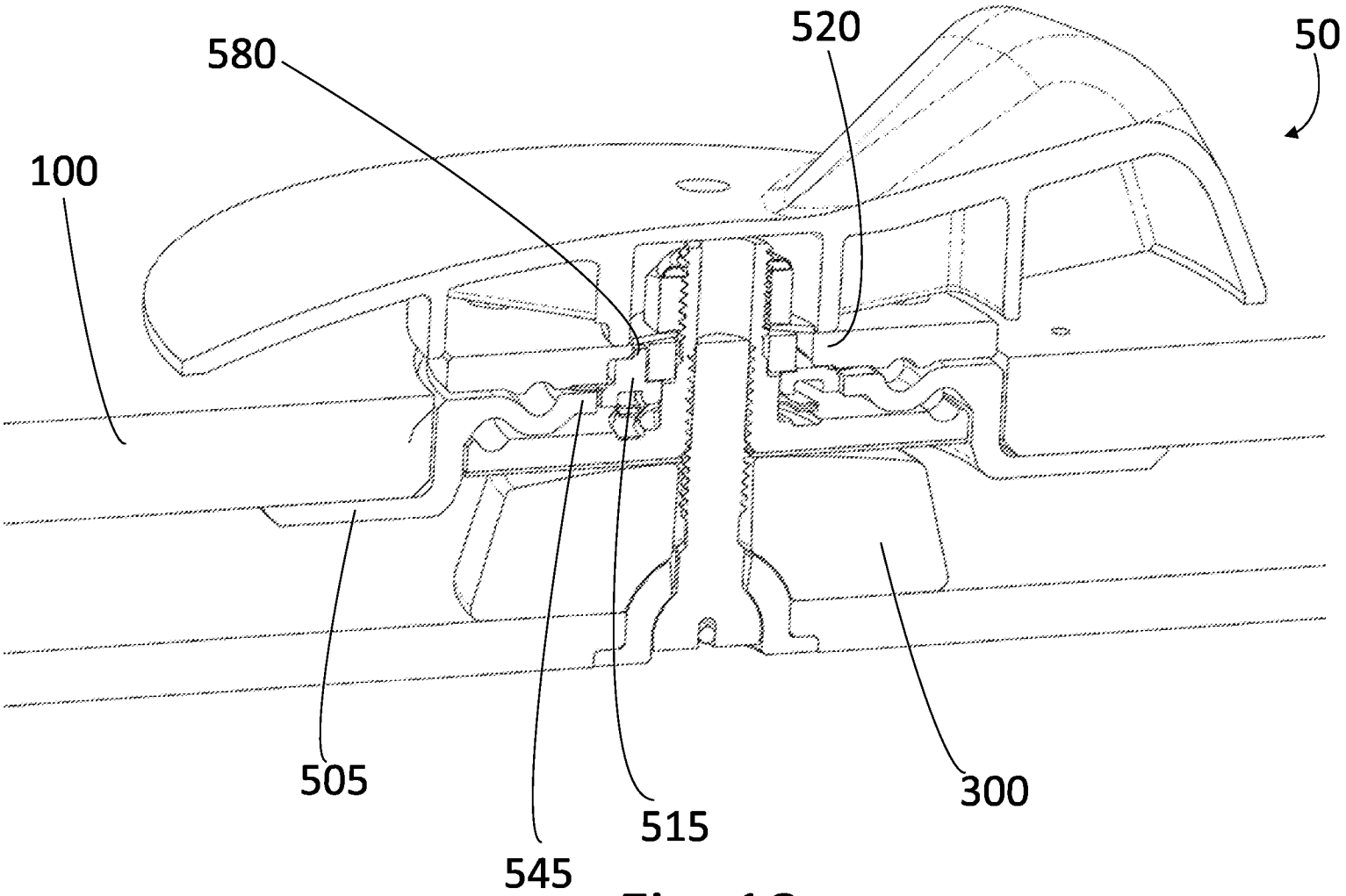
FIG. 18 is a cross-sectional view of the wobble board of FIG. 1 in adjustment mode.

Once the tabs 584 of each projection 580 are positioned in the second end 602 of the corresponding inclined groove, the wobble board 50 is in adjustment mode. A cross-sectional view of the wobble board 50 in adjustment mode is shown in FIG. 18. As can be seen, the interlock disc 515 is positioned such that the tab 584 of each projection 580 is positioned in the second end 602 of the corresponding inclined groove 600. In this position, the teeth 575 of the interlock disc 515 are engaged with the teeth 545 of the bearing plate 505.

Figure 19:
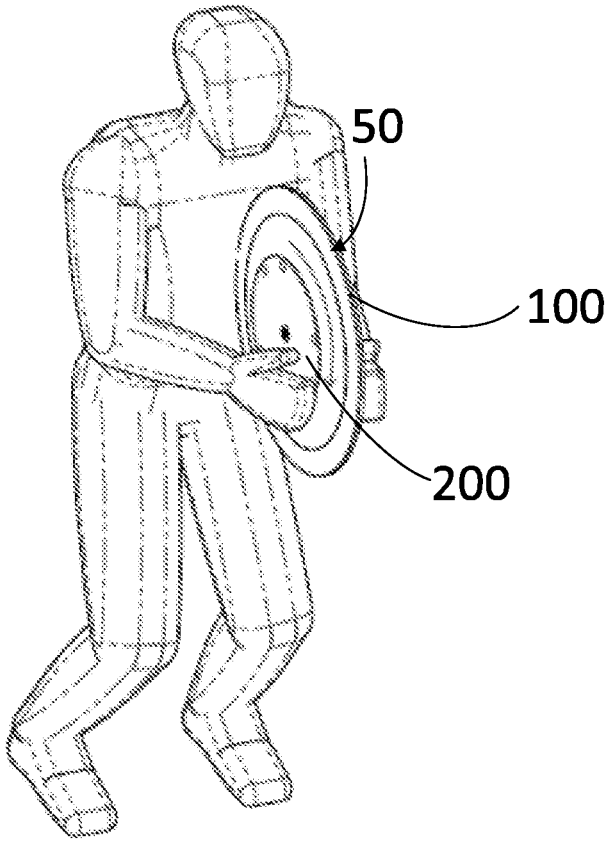
FIG. 19 is a plan view of a user adjusting the wobble board of FIG. 1 by hand.
Figure 20:
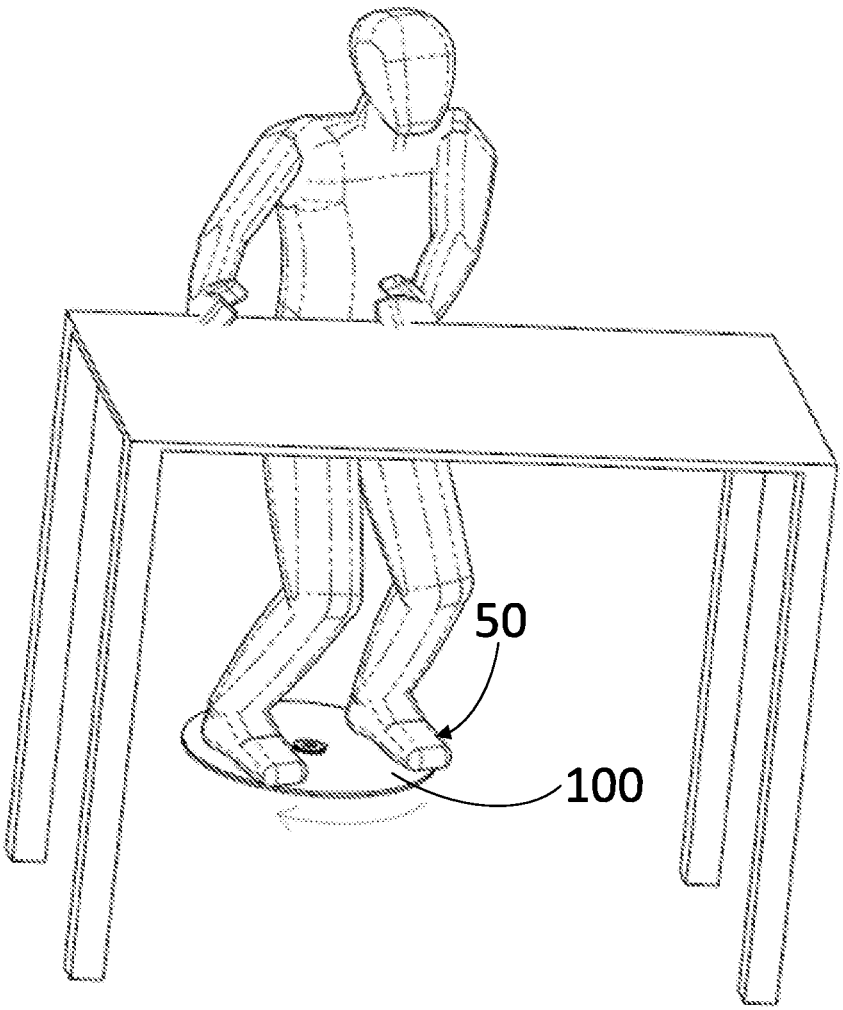
FIG. 20 is a plan view of a user adjusting the wobble board of FIG. 1 by standing on it.

As mentioned previously, during adjustment mode the user can adjust the level of compression of the compressible member 300 and thus can adjust the difficultly in balancing the wobble board 50. In adjustment mode, the platform 100 can be rotated by the user to adjust the level of compression of the compressible member 300. As the platform 100 is rotated, the threaded member 480 of the chassis 425 rotates with respect to the threaded shank 435. As such, the platform 100 is raised or lowered with respect to the base 200, based on a direction of rotation. As the platform 100 is raised or lowered, the level of compression of the compressible member 300 is adjusted. As shown in FIG. 19, the platform 100 may be rotated by hand. As shown in FIG. 20, the platform 100 may be rotated while the user is standing thereon.

Figure 21:
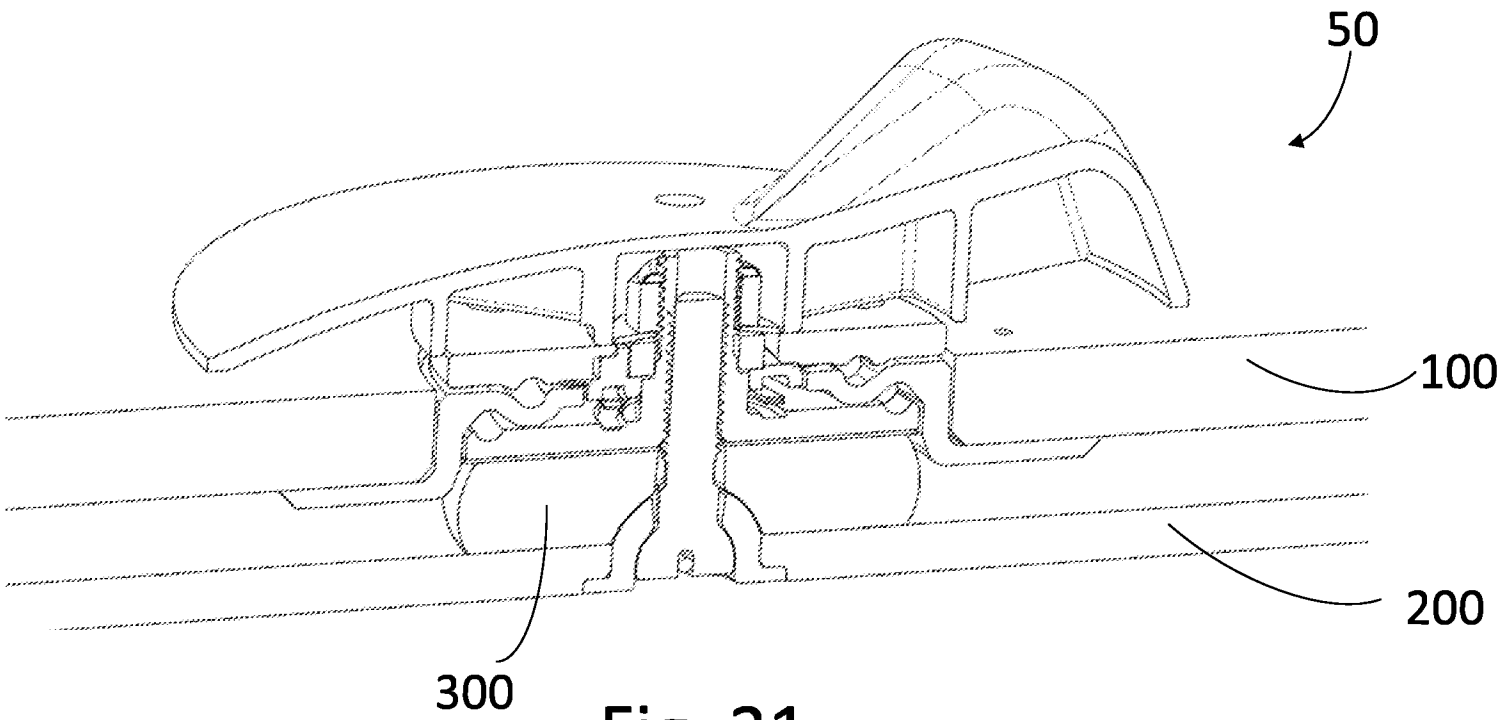
FIG. 21 is another cross-sectional view of the wobble board of FIG. 1 in adjustment mode.
Figure 22:
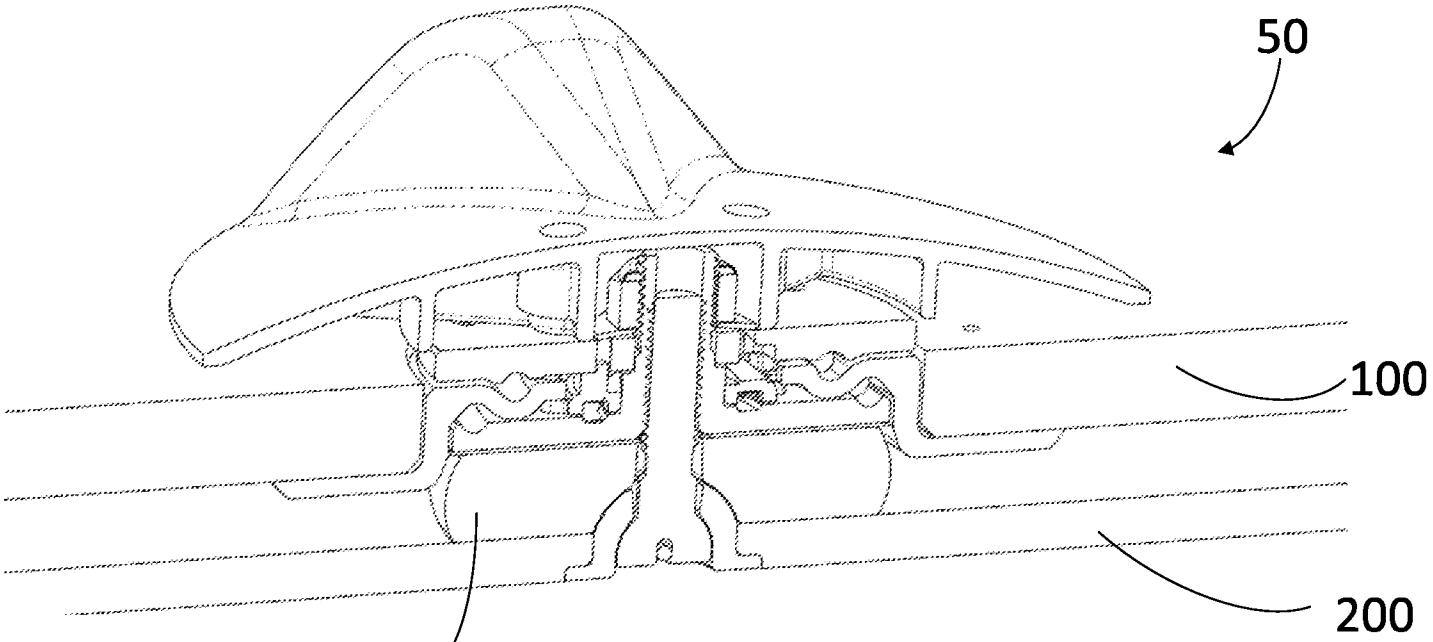
FIG. 22 is another cross-sectional view of the wobble board of FIG. 1 in use mode.

As shown in FIG. 21, the platform 100 has been lowered and thus is closer to the base 200 (compared to the example shown in FIG. 18). As such, the level of compression of the compressible member 300 is greater and the wobble board 50 is more stable (compared to the example shown in FIG. 18). The wobble board 50 is then set back to use mode by rotating the locking tab 620, as shown in FIG. 22.

As will be appreciated, the wobble board 50 may be used for recreation, balance training, athletic training, physiotherapy, rehabilitation and other kinds of personal development. The wobble board 50 can also be used by a user working at a stand-up desk. As the user increases their balance/strength, the wobble board 50 can be adjusted to increase the difficulty of use. In the event of an injury or due to aging, the wobble board 50 can be adjusted to decrease the difficulty of use.

Figure 23:
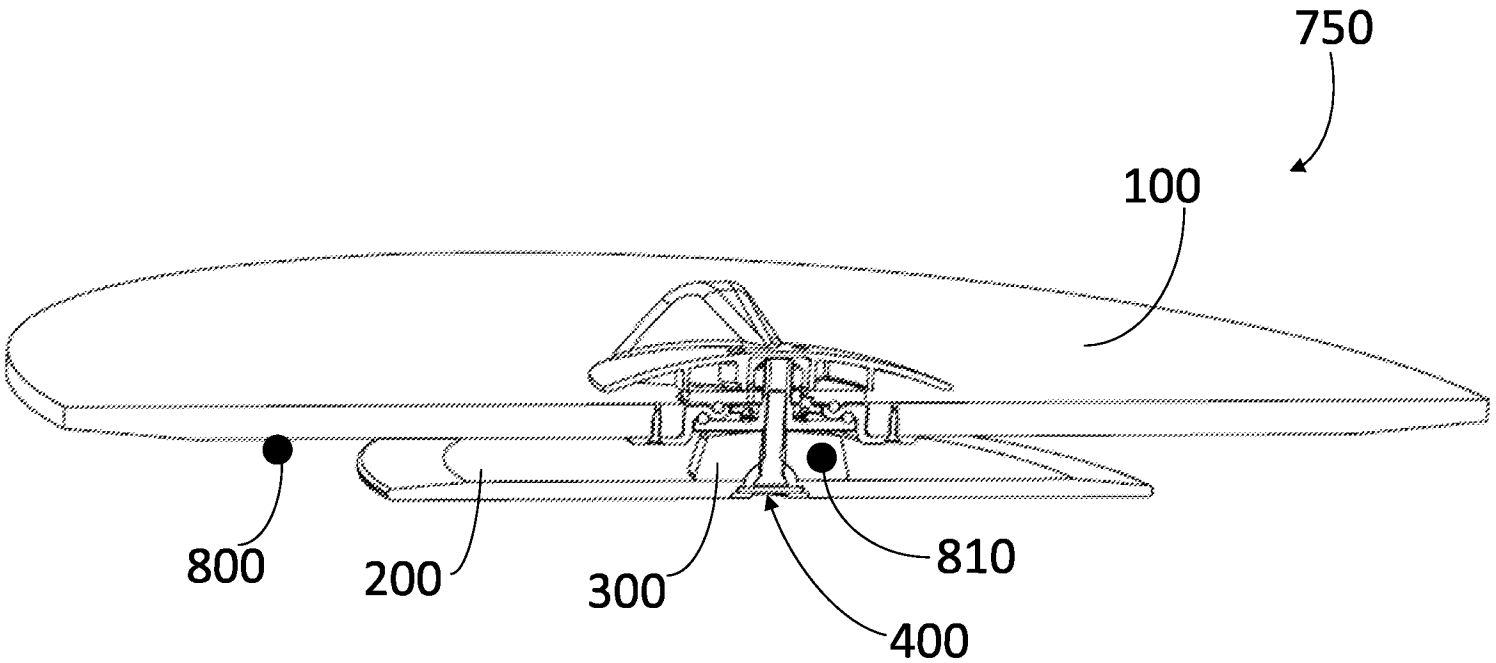
FIG. 23 is an isometric view of another form of a wobble board.

Turning now to FIG. 23, another form of a wobble board is shown and is generally identified by reference numeral 750. The wobble board 750 is generally identical to that of wobble board 50, with the following exceptions. In this form, the wobble board 750 comprises a number of sensors 800 and 810. Sensor 800 is configured to monitor a degree of pivot of the platform 100. Sensor 810 is configured to monitor the level of compression of the compressible member 300 and to monitor a force applied to the compressible member 300 which can be used to calculate a weight (or mass) of the user. As will be appreciated, other sensors may be employed to monitor additional parameters of the wobble board and may be placed at various locations thereon. For examples, strain gauges, proximity sensors, accelerometers, gyroscopes and magnetometers may be used. The sensors may be wire or wirelessly coupled to a mobile device, a gaming device and/or a computer and may communicate sensor data thereto for processing. For example, the wobble board may be connected to a gaming device. The sensors may communicate data about manipulation of the wobble board to the gaming device which can be processed or interpreted for gameplay. As another example, the wobble board may wirelessly connect to a mobile device. The sensors may communicate data about manipulation of the wobble board to the mobile device which can be processed or interpreted to assess health or fitness statistics of the user.

Figure 24:
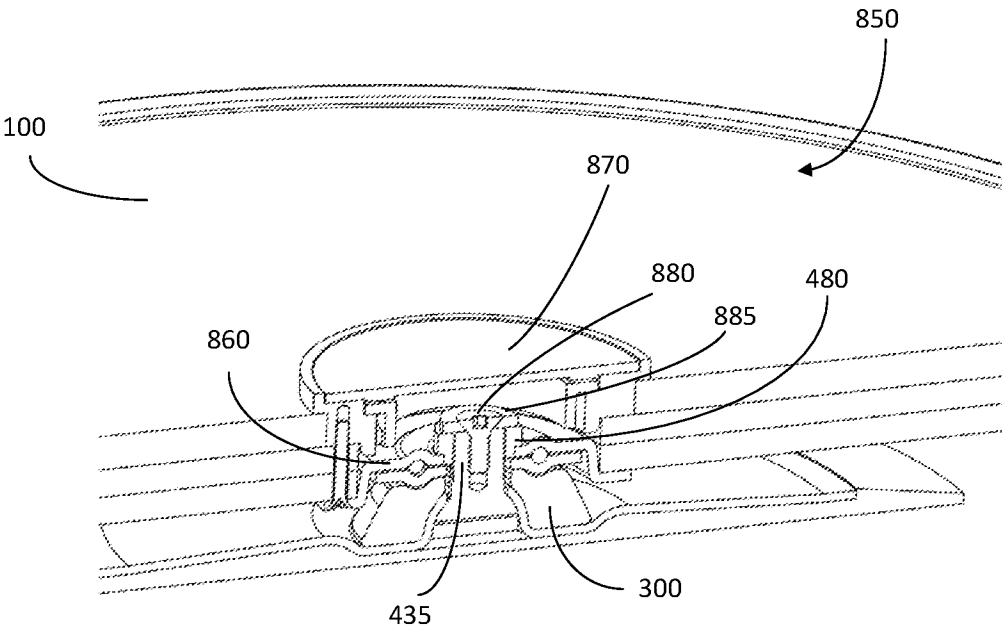
FIG. 24 is an isometric view of another form of a wobble board.

Turning now to FIG. 24, another form of a wobble board is shown and is generally identified by reference numeral 850. The wobble board 850 is generally identical to that of wobble board 50, with the following exceptions. In this form, the wobble board 850 does not have a locking mechanism. Specifically, the wobble board 850 does not have an interlock spring, an interlock disc, an interlock trigger plate or a locking member. Further, the bearing plate used by wobble board 50 is replaced with a bearing plate 860 which does not require teeth. In this form, the bearing plate 860 is attached to the threaded member 480. A machine screw 880 is threadably connected to interior threadings of the threaded shank 435. A washer 885 is positioned underneath a head of the machine screw 880. The machine screw 880 and washer 885 are used to provide that the threaded member 480 does not come off the threaded shank 435 when rotated.

Rather than a locking member, the wobble board 850 comprises a cap 870 dimensioned to cover the circular opening 105 of the platform 100.

In this form, since the wobble board 850 does not require a locking mechanism, the wobble board 850 operates in a single mode which is both an adjustment mode and a use mode. During use, a user stands on the top surface of the platform and tries to maintain the wobble board 850 in a balanced position. In the event the user would like to increase or decrease the difficulty of use of the wobble board 850, the user can adjust the level of compression of the compressible member 300 and thus can adjust the difficulty in balancing the wobble board 850. Specifically, the platform 100 can be rotated by the user to adjust the level of compression of the compressible member 300. As the platform 100 is rotated, the threaded member 480 rotates with respect to the threaded shank 435. As the platform 100 is raised or lowered, the level of compression of the compressible member 300 is adjusted. The machine screw 880 and washer 885 provide that the platform 100 is not rotated so far that it disconnects from the base 200. Similar to wobble board 50, the wobble board 850 may be adjusted by rotating the platform 100 by hand or while the user is standing thereon.

Figure 25A:
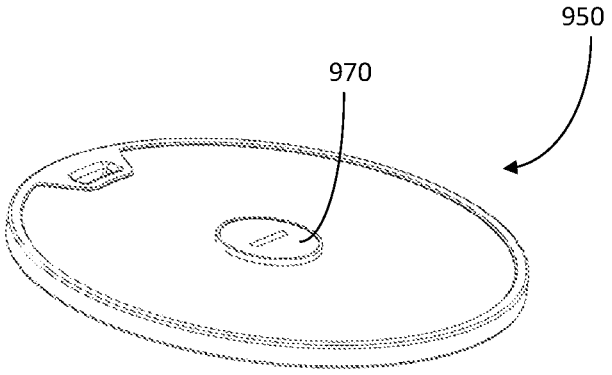
FIGS. 25A and 25B are isometric views of another form of a wobble board.
Figure 25B:
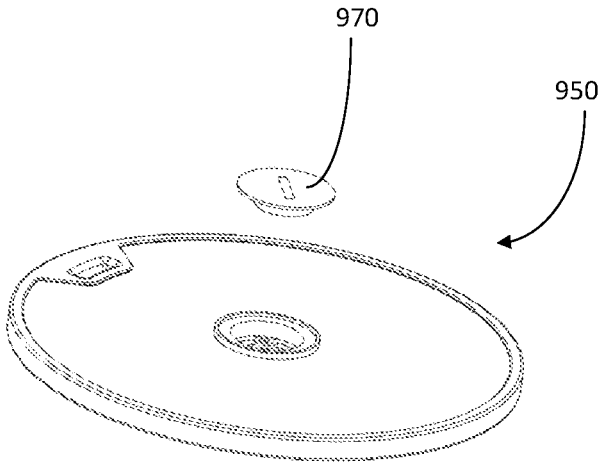

Turning now to FIGS. 25A and 25B, another form of a wobble board is shown and is generally identified by reference numeral 950. Wobble board 950 is generally identical to that of wobble board 850 with the following exception. In this form, the cap 970 is removable and thereby provides access to the various components of the wobble board. The cap 970 may be held in place via friction (see FIG. 25A) and may be readily be removed by the user (see FIG. 25B). In another form, the cap 970 may be threadably connected to the platform and may be removed by rotating it in a direction. In another form, the cap 970 may be connected to the platform using a bayonet mount. By providing access to the various components of the wobble board 950, additional components such as for example sensors, etc. may be added to the wobble board 950 as desired by the user.

Although in forms the limit as to how much the platform can pivot with respect to the base is defined by a support surface on which the wobble board is placed on, in another form the limit as to how much the platform can pivot with respect to the base may be defined by a feature on the base. In this form, the feature is connected to the base and in positioned such that it interferes with movement of the platform as it pivots with respect to the base. Put another way, the platform 100 can only pivot with respect to the base 200 until a portion of the platform 100 contacts the feature on the base, thereby inhibiting further pivot.

Although in forms the platform is described as being generally annular shaped, those skilled in the art will appreciate that alternatives are available. For example, in another form the platform may be shaped like a surfboard or a snowboard and thus can be used for athletic training purposes.

In another form of a wobble board, a layer of high friction or gripping material may be placed on the platform for safety purposes to reduce the likelihood of a user slipping. The platform may comprise printed matter such as instructions or arrows to guide the user on how to transition between use mode and adjustment mode. In another form, a layer of compressible material such as for example rubber or foam may be placed atop the platform for comfort. In another form, a layer of textured material such as for example corrugated rubber or foam may be placed atop the platform. In another form, the wobble board may be positioned such that the platform is flush with a surrounding foam mat.

In another form of a wobble board, the base may include one or more adjustable feet or screws to provide that the wobble board lays flat on an otherwise uneven support surface.

In another form of a wobble board, the compressible member may be replaceable. In this form, the compressible member may be replaced with a compressible member having a different range of compression or elasticity. This will further allow the user to increase or decrease the difficulty of the wobble board.

In another form, more than one compressible member may be used.

Although in forms above the compressible member is described as being generally frustoconical shaped, those skilled in the art would appreciate that the compressible member may be of another shape such as for example cylindrical shaped, annular shaped, etc.

Although in forms above the compressible member is described as being made of a resilient material such as rubber or elastomer, those skilled in the art would appreciate that the compressible member may be made of other materials such as for example foam. In another form, the compressible member may be made of an expandable material filled with fluid. In another form, the compressible member may be made of metal having a number of spring-like members. In another form, the compressible member may be a large coil spring or a disc spring. In another form, the compressible member may be one or more discrete air springs.

Although in forms, the compressible member is described as expanding radially in response to an axial force applied thereto, those skilled in the art will appreciate that alternatives are available. For example, in another form the compressible member may compress axially. In another form, the compressible member may compress axially and expand radially.

In another form of a wobble board, the locking mechanism may comprise a button used to switch between use and adjustment modes.

Although in forms above the fasteners are described as being in the form of a screw, those skilled in the art will appreciate that any type of fastener may be used.

Although in forms above the platform and base are described as being generally annular shaped, those skilled in the art will appreciate that the platform and base may be other shapes such as for example square shaped, rectangular shaped, octagonal shaped, etc.

Although in forms the wobble board is described as having an interlock spring used to exert a generally upward force on the interlock disc, those skilled in the art will appreciate that alternatives are available. For example, in another form, the interlock spring may be replaced with a foam washer.

Although in forms the interlock disc is described as comprising projections is in the shape of a curved-ramp and the interlock trigger plate is described as comprising inclined grooves, those skilled in the art would appreciate that alternatives are available. For example, in another form, the projections may be small nubs extending from the top surface of the interlock disc and configured to travel along the inclined grooves of the interlock trigger plate.

Although in forms ball bearings are used, those skilled in the art will appreciate that alternatives are available such as for example low friction washers.

Other aspects of the present disclosure are exemplified in the following clauses:

A1. A wobble board comprising:

a platform;

a base having a generally flat bottom surface; and at least one compressible member positioned intermediate the platform and the base such that the platform is pivotable with respect to the base.

A2.1 The wobble board of clause A1 wherein the at least one compressible member compresses in response to an axial force being applied thereto.

A2.2. The wobble board of clause A2.1, further comprising an adjustment mechanism configured to adjust a level of compression of the at least one compressible member.

A3. The wobble board of clause A2.2, wherein the axial force is at least partially from the adjustment mechanism.

A4. The wobble board of clause A2.2 wherein the adjustment mechanism comprises a threaded member connecting the platform to the base.

A5. The wobble board of clause A4 wherein rotation of the platform relative to the base via the threaded member adjusts the level of compression of the at least one compressible member.

A6. The wobble board of clause A5 wherein the wobble board is operable in a single mode.

A7. The wobble board of clause A5 further comprising a locking mechanism configured to set the wobble board in use mode or adjustment mode.

A8. The wobble board of clause A7 wherein in a first position, the locking mechanism sets the wobble board to use mode, and in a second position, the locking mechanism sets the wobble board to adjustment mode.

A9. The wobble board of clause A8 wherein the locking mechanism is rotatable between the first and second positions.

A10. The wobble board of clause A9 wherein the locking mechanism is positioned on a top surface of the platform.

A11. The wobble board of clause A9 wherein the locking mechanism comprises:

an interlocking plate positioned on the top surface of the platform and comprising at least one inclined groove; and a disc comprising a plurality of teeth positioned within an opening of the platform adjacent the interlocking plate, the disc having at least one locking member projecting from a surface thereof.

A12. The wobble board of clause A11, wherein in the first position, the locking member is positioned within the inclined groove at a lowest point thereof, and in the second position the locking member is positioned within the inclined groove at a highest position thereof.

A13. The wobble board of clause A2.2 wherein the greater the level of compression of the at least one compressible member the less range of pivot the platform has relative to the base.

A14. The wobble board of clause A1, wherein the axial force is at least partially from a force being applied to a top surface of the platform.

A15. The wobble board of clause A14, wherein the force applied to the top surface of the platform is from a user standing on the platform.

A16. The wobble board of clause A1, wherein the base is positioned on a support surface, the support defining a pivot limit of the platform.

A17. The wobble board of clause A16, wherein at least a portion of the platform is in contact with the support surface when at the pivot limit.

A18. The wobble board of clause A1 wherein the at least one compressible member is made of one of an elastic material, a rubber material and a foam material.

A19. The wobble board of clause A1 wherein the at least one compressible member has a rounded top surface.

A20. The wobble board of clause A1 wherein the at least one compressible member compresses axially.

A21. The wobble board of clause A1 wherein the at least one compressible member expands radially when compressed axially.

B1. A method of adjusting a wobble board comprising:

providing a platform, a base, at least one compressible member positioned intermediate the platform and the base, and an adjustment mechanism comprising a threaded member connecting the platform to the base;

rotating the platform relative to the base such that the platform is raised or lowered with respect to the base via threaded member thereby adjusting a level of compression of the compressible member.

B2. The method of clause B1 wherein rotating the platform relative to the base in a first direction raises the platform with respect to the base and in a second direction lowers the platform with respect to the base.

B3. The method of clause B1 wherein rotating the platform relative to the base such that the platform is lowered with respect to the base decreases a difficulty of use of the wobble board.

B4. The method of clause B1 wherein rotating the platform relative to the base such that the platform is raised with respect to the base increases a difficulty of use of the wobble board.

C1. A wobble board comprising:

a platform;

a base having a generally flat bottom surface; and at least one compressible member positioned intermediate the platform and the base such that the platform is pivotable with respect to the base, the at least one compressible member configured to compress in response to an axial force being applied thereto;

an adjustment mechanism comprising at least one threaded member connecting the platform to the base such that the platform is rotatable with respect to the base, wherein rotation of the platform in a first direction raises the platform with respect to the base and rotation of the platform in a second direction lowers the platform with respect to the base;

wherein a level of compression of the at least one compressible member increases when the platform is lowered with respect to the base thereby decreasing a difficulty of use of the wobble board and decreases when the platform is raised with respect to the base thereby increasing a difficulty of use of the wobble board.

C2. The wobble board of clause C1 wherein the at least one threaded member extends through an opening in the compressible member.

C3. The wobble board of clause C1 wherein the at least one compressible member is made of a rubber material.

C4. The wobble board of clause C1 further comprising at least one sensor obtaining sensor data associated with at least one of a level of compression of the compressible member and movement of the wobble board.

C5. The wobble board of clause C1 wherein the at least one compressible member is made of one of an elastic material, a rubber material and a foam material.

C6. The wobble board of clause C1 wherein the at least one compressible member has a rounded top surface.

C7. The wobble board of clause C1 wherein the at least one compressible member compresses axially.

C8. The wobble board of clause C1 wherein the at least one compressible member expands radially when compressed axially.

Although variations have been described above with reference to the accompanying drawings, those of skill in the art will appreciate that variations and modifications may be made without departing from the scope thereof as defined by the appended claims.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A wobble board comprising:

a platform;

a base having a flat bottom surface positioned on a support surface such that the base is held in a fixed position;

at least one compressible member positioned intermediate the platform and the base such that the platform is pivotable with respect to the base; and an adjustment mechanism comprising a threaded member and a threaded shank engaged with one another and connecting the platform to the base such that a rotation of the platform relative to the base rotates the threaded member with respect to the threaded shank and adjusts a level of compression of the at least one compressible member and thereby adjusts a difficulty of use of the wobble board, the adjustment mechanism is configured such that the adjustment mechanism is adjusted by rotating the platform while a user remains standing thereon.

2. The wobble board of claim 1 further comprising a locking mechanism configured to set the wobble board in use mode or adjustment mode.

3. The wobble board of claim 2 wherein in a first position, the locking mechanism sets the wobble board to use mode, and in a second position, the locking mechanism sets the wobble board to adjustment mode.

4. The wobble board of claim 3 wherein the locking mechanism is rotatable between the first and second positions.

5. The wobble board of claim 4 wherein the locking mechanism comprises:

an interlocking plate positioned on the top surface of the platform and comprising at least one inclined groove; and a disc comprising a plurality of teeth positioned within an opening of the platform adjacent the interlocking plate, the disc having at least one locking member projecting from a surface thereof.

6. The wobble board of claim 5, wherein in the first position, the locking member is positioned within the inclined groove at a lowest point thereof, and in the second position the locking member is positioned within the inclined groove at a highest position thereof.

7. The wobble board of claim 4 wherein the locking mechanism is positioned on a top surface of the platform.

8. The wobble board of claim 1 wherein the at least one compressible member compresses in response to an axial force being applied thereto.

9. The wobble board of claim 8, wherein the axial force is at least partially from a force being applied to a top surface of the platform.

10. The wobble board of claim 9, wherein the force applied to the top surface of the platform is from the user standing on the platform.

11. The wobble board of claim 8, wherein the axial force is at least partially from the adjustment mechanism.

12. The wobble board of claim 1, wherein the support surface defines a pivot limit of the platform.

13. The wobble board of claim 12, wherein at least a portion of the platform is in contact with the support surface when at the pivot limit.

14. The wobble board of claim 1 wherein the wobble board is adjustable and useable in a single mode.

15. The wobble board of claim 1 wherein a greater the level of compression of the at least one compressible member a less range of pivot the platform has relative to the base.

16. The wobble board of claim 1 wherein the at least one compressible member is made of one of an elastic material, a rubber material and a foam material.

17. The wobble board of claim 1 wherein the at least one compressible member has a rounded top surface.

18. The wobble board of claim 1 wherein the at least one compressible member compresses axially.

19. The wobble board of claim 1 wherein the at least one compressible member expands radially when compressed axially.

* * * * *